US006500025B1

(12) United States Patent
Moenkhaus et al.

(10) Patent No.: US 6,500,025 B1
(45) Date of Patent: Dec. 31, 2002

(54) UNIVERSAL CABLE ASSEMBLY FOR BOTH PARALLEL AND SERIAL COMPONENT CONNECTIONS

(75) Inventors: Patrick R. Moenkhaus, Mounds View, MN (US); Timothy F. McCarthy, Plymouth, MN (US); Edward L. Schwarz, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/096,998

(22) Filed: Mar. 13, 2002

(51) Int. Cl.[7] ..... H01R 27/00

(52) U.S. Cl. ..... 439/502; 439/218; 439/507; 439/638

(58) Field of Search ..... 439/502, 217, 439/218, 507, 508, 509, 638

(56) References Cited

U.S. PATENT DOCUMENTS 4,297,627 A 10/1981 Schaefer ..... 318/778
5,340,331 A * 8/1994 Bohlen et al. ..... 439/502
5,375,524 A 12/1994 Larson ..... 102/217
5,599,204 A * 2/1997 Glassford ..... 439/502
5,855,494 A * 1/1999 Blaszczyk et al. ..... 439/502
5,954,538 A * 9/1999 Huang ..... 439/502
5,961,207 A * 10/1999 Petkovic ..... 362/376
6,050,840 A * 4/2000 Kowalski et al. ..... 439/369
6,190,199 B1 * 2/2001 Bump et al. ..... 439/540
6,328,597 B1 * 12/2001 Epps ..... 439/502

* cited by examiner

*Primary Examiner*—P. Austin Bradley
*Assistant Examiner*—Truc Nguyen
(74) *Attorney, Agent, or Firm*—Kris T. Fredrick

(57) ABSTRACT

A connector cable assembly has first and second plugs wired to permit plugging into a first pair of electrical plugs with a pair of terminals in a first configuration to place the terminals of those plugs in parallel connection, and to permit plugging into a second pair of electrical plugs with a pair of terminals in a second configuration, to place the terminals of those plugs in series connection. In a commercial embodiment, such a cable assembly can be used to provide power to electrical devices such as gas valves connected to receive power in parallel from the first pair of electrical plugs, and to connect in series, safety switches connected to plugs with a pair of terminals in the second configuration. By using an adapter with specialized connections between two sets of terminals it is possible to use additional cable assemblies to connect in excess of two switches in series.

11 Claims, 2 Drawing Sheets

UNIVERSAL CABLE ASSEMBLY FOR BOTH PARALLEL AND SERIAL COMPONENT CONNECTIONS

BACKGROUND

Two types of components are used in certain electrical systems. Two or more of a first type must be connected in parallel with each other. Two or more of a second type must be connected in series with each other. One such electrical system is that for controlling flow of gaseous fuel to a burner. An electronic controller provides the operating power to the various components of the burner control system. Burners, particularly larger ones, have a number of operating requirements for safety. For example, startup must proceed according to a prescribed series of steps involving combustion chamber purging and proving pilot flame. During normal combustion, it is important to constantly monitor the output of a flame detector. If flame is not present, then the flow of fuel to the combustion chamber must be immediately stopped to prevent dangerous accumulations of unburned fuel.

Because the potential for harm when fuel flows uncontrollably is so great, it is customary to have two valves in series flow relationship so if one fails in the open position, the other will still be closed to prevent flow of fuel to the combustion chamber. These valves typically have electrical operators or solenoids to open and close them, with the power for operating them provided by the controller. While the valves are in series flow relationship, their operators are in parallel electrical connection, so that the controller can provide operating power at a single source for simultaneously opening and closing them.

In operating a burner, a number of operating conditions must be present for safety. For the burner itself, proper fuel pressure, sufficient combustion air, and presence of flame are necessary. In a case where the burner is used to heat water or generate steam, other conditions must also be present, such as proper water temperature and water pressure. It is customary to sense many of these conditions with safety or limit switches that open if the condition is not within the preset range. All of these safety switches are connected in series to provide power to the controller or to provide power for the valve operators when all are sensing conditions within the preset limits. If any condition is outside its prescribed limit, the associated switch opens, removing power to the valve operators, and causing the fuel valves to close. For example high and low pressure sensor switches sense fuel pressure. If the fuel supply pressure is below the low-pressure limit setting or above the high-pressure limit setting, the associated switch opens.

Proper installation is a concern with these burner control systems. For example, if the safety switch for a particular condition is omitted or by-passed by mistake or is wired in parallel with another switch, the safety test is absent. Where a number of switches are present in a burner installation, it is relatively easy to miswire one or more switches and relatively difficult to detect the miswires. Accordingly, the fewer switches that must be individually wired by the installer the better.

Limiting the number of parts and wiring present in a burner installation saves cost. If it is possible to use identical parts for different purposes in an installation, returns to scale reduce cost of that part. Further, internal point-to-point wiring within a component of the system is time consuming and thus relatively expensive, so replacing this wiring with more standardized wiring reduces cost.

One way to accomplish this is by combining related safety switches and the fuel valve sets in a single package. First of all, this is less costly because a large number of a few identical devices can be made in a factory setting. Secondly, by combining many of these components in the same package, the space required is reduced. Space in many installations is limited, so by combining a number of required or common components in a single package, the installation process is simplified and less likely to have errors. We find that one particularly advantageous package combines fuel pressure safety switches and two fuel valves with their operators. We will call a package containing both a pair of pressure safety switches mounted to sense out of range inlet fuel pressure and a pair of fuel valves in series, each with their own operator, a fuel control module.

BRIEF DESCRIPTION OF THE INVENTION

We have developed a universal cable assembly that can be used either for connecting components in serial or parallel. This cable assembly has particular advantage for wiring or connecting fuel control modules. Such a cable assembly comprises a (usually) flexible cable with first and second ends, and having at least first and second internal conductors insulated from each other. A first connector plug is mechanically attached to the first end of the cable. The connector plug has at least first, second, and third terminals. By "terminal" we mean a conductive element designed to make electrical contact with another conductive element carried on a separate connector plug, and which may be but not necessarily is, electrically connected to a conductor in the cable. The first plug's first and third terminals are electrically connected with each other and with the first conductor. The first plug's second terminal is electrically connected with the second conductor.

A second connector plug is mechanically attached to the second end of the cable and also has at least first, second, and third terminals. The first terminal is electrically connected to the first conductor, and the second terminal is electrically connected to the second conductor. A third terminal is not connected to either conductor.

A cable assembly conforming to nothing more than this broad statement of the invention has little use. In a preferred embodiment, each of the first and second plugs includes first through third slots, for respectively receiving first through third connecting pins and within each of which is respectively the first through third terminal. The terminals within the slots are shaped and positioned to make electrical contact with the connecting pin within the slot. Further, this preferred cable assembly has for each of the second plug's terminals, a projecting connecting pin. Since usually these components will be assembled in a factory environment, the likelihood of proper connection from the component terminals to the plug terminals is quite high.

The slots in the two plugs and the connecting pins of the second plug should all have what we call "predetermined polarized geometry". By this we mean that all of the pins in the second plug will simultaneously mate with their respective slots of either plug in only one orientation of the pins with respect to the slots and while mated, make electrical connection with the terminals within the slots, first pin in first slot, second pin in second slot, etc. Such a cable assembly can be used either to connect in series two safety switches each having two connecting pins mounted to match the predetermined polarized geometry, or to connect two valve operators in parallel, each operator having two connecting pins mounted to match the predetermined polarized geometry.

The design makes it irrelevant which plug of the assembly is connected to a particular one of the switches or the operators, and which to the other. Of course, the switches and the operators must be properly connected to their connector pin sets for the proper connection of the individual components to each other, and to the controller.

In one embodiment of the invention, the connecting pins of each of the safety switches must connect to the second and third terminals of each plug.

By using a special adapter, two or more of these cable assemblies can be used to connect more than two devices in series. Such an adapter comprises a plug having a first surface having therein first through third slots having a predetermined polarized geometry. The respective one of first through third conductive pins may be inserted into each of these slots. A first terminal is mounted in the first slot to make electrical contact with an inserted connecting pin. A third terminal is mounted in the third slot to make electrical contact with an inserted connecting pin. A second surface of the adapter has at least second and third conductive pins projecting therefrom and has the predetermined polarized geometry of the second and third slots. The second pin is electrically connected to the first terminal and said third pin is electrically connected to the third terminal. This arrangement creates the situation where the two devices connected in series by the first cable assembly appear across the adapter's second and third pins as a single two-terminal switch or other device.

DESCRIPTION OF THE PREFERRED EMBODIMENT

Figure 1:
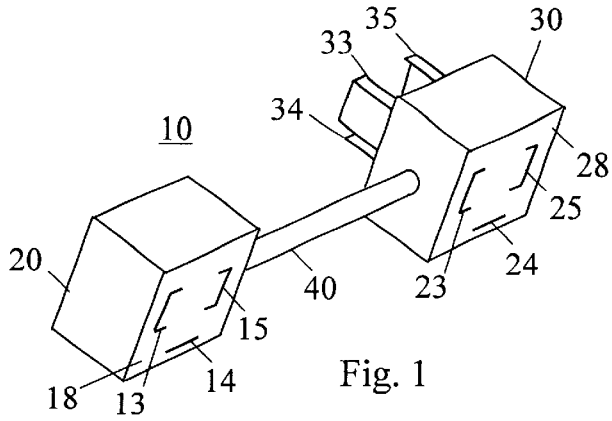
FIG. 1 is a perspective drawing of a universal cable assembly comprising the invention.
Figure 2:
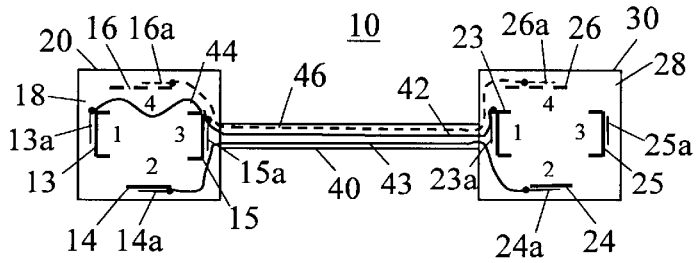
FIG. 2 is an elevation view of a first side of the cable assembly.
Figure 3:
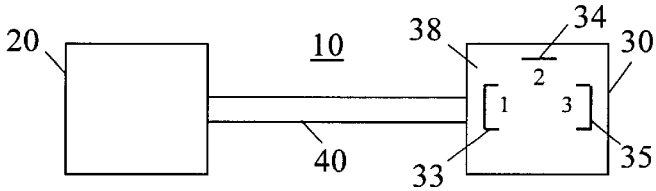
FIG. 3 is an elevation view of a second side, opposite to the first side, of the cable assembly.

Turning first to FIGS. 1–3, the universal cable assembly 10 is shown with a first plug 20 and a second plug 30 electrically and mechanically connected by a short length of flexible two or three-conductor cable 40. One suitable type of plug for use as plugs 20 and 30 is that designated as DIN 43650. Plugs 20 and 30 shown are intended to replicate the 43650 and similar units. Plug 20 has first through third slots or sockets 13, 14, and 15 (sharing the 1, 2, 3 labeling) on a surface 18 and arranged in a predetermined polarized geometry as defined above. The term "slot" is intended to include various shapes of sockets or apertures. Electrical contacts or terminals 13*a*, 14*a*, and 15*a* are located within sockets 13–15 respectively to allow electrical contact with conductive pins entering the slots. This sort of arrangement of course has been well known for literally many decades-consider the ubiquitous wall plug for electrical power connection.

Plug 30 has three slots or sockets 23, 24, and 25 on a surface 28 and preferably arranged in the same predetermined polarized geometry as are the slots or sockets 13–15. Electrical slot contacts or terminals 23*a*, 24*a*, and 25*a* are located within slots 23–25 respectively and are similar to terminals 13*a*, 14*a*, and 15*a* to allow electrical contact with conductive pins entering these slots.

As shown in FIGS. 1 and 3, plug 30 also has conducting pin terminals 33–35 projecting from a surface 38 opposite surface 28. Pin terminals 33–35 are electrically connected to slot terminals 23*a*, 24*a*, 25*a* respectively. It is best if pins 33–35 have the predetermined polarized geometry of slots 13–15 and 23–25. That is, the projective pattern or footprint of pin terminals 33–35 as shown in FIGS. 1 and 3 preferably matches the pattern of the slots 13–15 or 23–25, and in only one angular orientation where all of the pins 33–35 are mated or aligned with corresponding slots. This allows pin terminals 33–35, or a set of pin terminals that are identical, to enter a set of slots similar to those at 13–15 and 23–25. While slots and pins are far and away the most common and desirable types of terminals, other types of terminals such as surface conductive patches are not excluded by this disclosure.

First and second conductors 42 and 43 in cable 40 electrically connect terminals in plug 20 to slot and pin terminals in plug 30. First conductor 42 is electrically connected to terminal 23*a* of plug 30 and to both terminals 13*a* and 15*a* in plug 20. A jumper 44 within plug 20 connects terminals 15*a* and 13*a*. Presence of jumper 44 allows for the alternative serial and parallel connection using the same cable assembly 10. Second conductor 43 is electrically connected to terminal 24*a* of plug 30 and to terminal 14*a* in plug 20.

One non-essential alternative is the ground terminal 4 16*a* in plug 20 and ground terminal 4 26*a* in plug 30. Terminals 16*a* and 26*a* are mounted within slots 16 and 26 respectively to make contact with connector pins, and are electrically connected to each other by a third conductor 46 in cable 40 shown as a dashed line in FIG. 2. As a general observation, it may be convenient to mold all of the terminal, plug, and conductor components as a single unit for cost savings rather than as the separate components implied in the drawings.

FIG. 3 shows the cable assembly 10 of FIG. 2 with the surface 38 from which terminals 33–35 project, in elevation view. This view shows the predetermined polarized geometry for the pin set 33–35, which also duplicates the geometry of the slot sets 13–15 and 23–25. Of course, each set of slots and pins may use a unique geometry, but there is little reason to do so.

Figure 4:
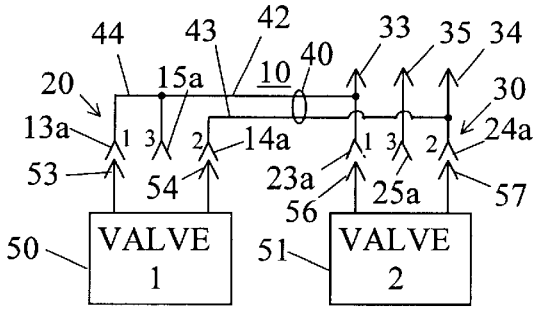
FIG. 4 is a wiring diagram of the cable assembly connecting a pair of valve operators in parallel.
Figure 5:
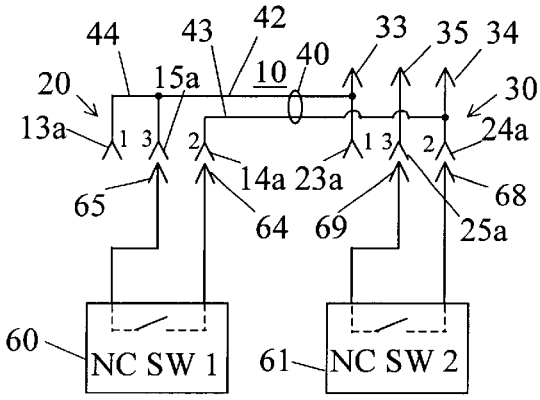
FIG. 5 is a wiring diagram of the cable assembly connecting a pair of safety switches in series.

The circuit or wiring diagrams of FIGS. 4 and 5 show distinguishing features of the invention. As has already been explained, a connector cable incorporating this invention can be used to electrically connect two two-terminal system components having properly constructed connection pin sets in either series or in parallel irrespective of the plugs 20 and 30 making the connections to the components. In FIGS. 4 and 5 the schematic of the individual plugs 20 and 30 shows each pin terminal 33–35 as an inverted "V" or arrowhead representing a male terminal terminating the conductor connected to the corresponding slot terminal 13*a*–15*a* and 23*a*–25*a*. Slot terminals 13*a*–15*a* and 23*a*–25*a* are also shown as inverted "V's", but with the conductor involved exiting from the tip of the inverted "V" to thereby represent a female terminal. The numeric labels 1–3 on the terminals in FIGS. 4 and 5 track the labels in FIGS. 2 and 3.

In FIG. 4, the components to be connected in parallel to receive power are valve 1 50 and valve 2 51. Two-terminal components to be connected in parallel with each other may be referred to as type A components. A controller and cable, not shown, supply power for both valves 50 and 51 to terminals (1 and 2) 33 and 34 of cable assembly 10. In this parallel configuration, terminals 3 15*a*, 25*a*, and 35 are unused. Valves 50 and 51 must have pin terminals 53–54 and 56–57 arranged with the predetermined polarized geometry as pins 1 and 2 to fit in slots 13–14 and 23–24. Of course a dummy pin 3 on either or both of valves 50 and 51, to fit in slots 15 and 25 may be present. Connected as shown, pins 1 53 and 56 and pins 2 54 and 57 are electrically connected in parallel across pins 33 and 34. The pins 33–34 can be used without regard to selection or orientation of such cable assemblies 10 to piggyback or daisy chain many valve operators using additional cable assemblies 10 identical as to terminal connections but perhaps of differing cable 40 lengths.

In FIG. 5, normally closed safety switches (1 and 2) 60 and 61 are to be electrically connected in series across pin 1 33 and pin 3 35 of a cable assembly 10 identical to that of FIG. 4. Such two-terminal components to be connected in series may be referred to as type B components. Switches 60 and 61 in this application are intended to sense insufficient pressure and excessive pressure in a fuel supply whose flow is to be regulated by valves 1 and 2 50 and 51. If out-of-range pressure is detected by either one of the switches 60 and 61, that switch opens, removing the electrical connection between pins 33 and 35. Pins 33 and 35 are to be used to conduct power to a device such as a burner during normal conditions, and remove power from that device when either switch 60 or 61 detects an abnormality. Of course, many other conditions besides abnormal pressure may also be checked using such switches. In this use, terminals 1 13*a* and 23*a* and pin 34 are not used.

A problem that can arise with the use of assembly 10 is where more than two type B components are to be connected in series. In the context of a burner control system's valves and switches, certain applications may require more than two switches. For example, if the burner is used to heat water or make steam, testing for water pressure or temperature within preselected limits may be important. Such limit testing may require a string of more than two limit switches. We find that it is-useful to include more than two switches while still using additional cable assemblies 10.

However, two or more cable assemblies 10 cannot be directly connected to achieve a series connection of more than two switches. We find that an adapter 70 shown in FIG. 6 can be devised that allows assemblies 10 to connect more than two switches (or other type B components) in series. Adapter 70 has a specific internal structure that allows daisy chaining of assemblies 10.

Figure 6:
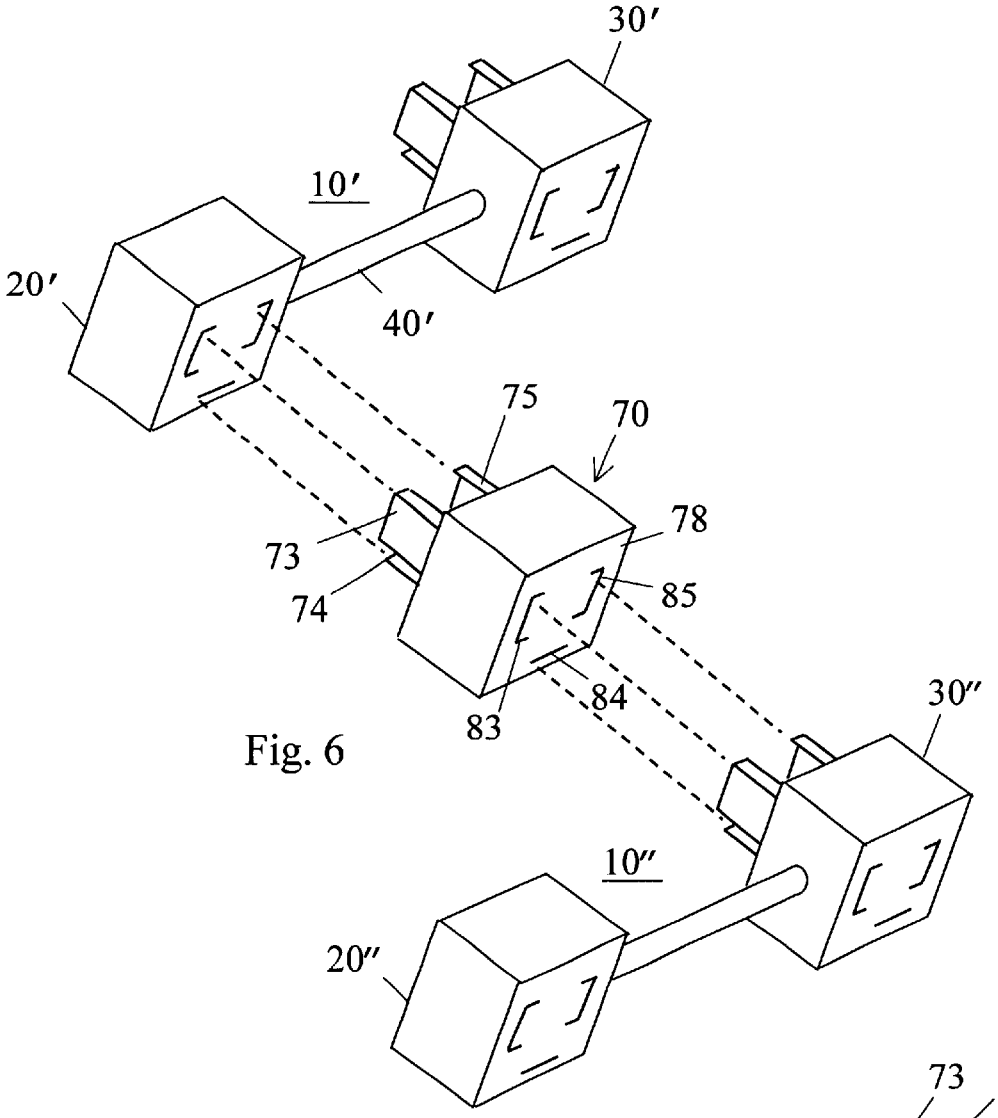
FIG. 6 is a perspective drawing of two universal cable assemblies similar to that of FIG. 1, and an adapter block for allowing three switches to be placed in series connection using these universal cable assemblies.

FIG. 6 shows adapter 70 in exploded view positioned to form an interface between cable assemblies 10' and 10" thereby allowing connecting additional switches in series. Two switches are to be plugged into the slots of plugs 20" and 30" as is shown in FIG. 5. A third switch is to be plugged into the slots of plug 30'. When so connected and with the pins 73–75 of adapter 70 plugged into the slots of plug 20' and the pins of plug 30" plugged into slots 83–85, the three switches will be connected in series with each other, and across pins 1 and 3 of plug 30'.

An adapter 70 suitable for connecting cable assemblies for this purpose comprises a rectangular block 78 having on a first surface thereof a set of slots or sockets 83–85 whose geometry precisely matches the pins of plug 30". Adapter 70 further includes a set of pins 73–75 whose geometry precisely matches the slots of plug 20'.

Figure 7:
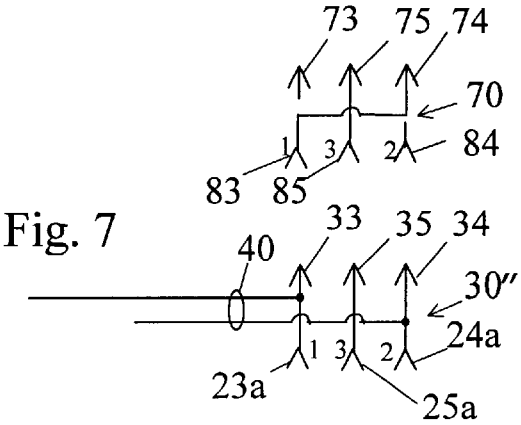
FIG. 7 is a wiring diagram of a part of a universal cable assembly and the adapter block.

Internally, as shown in FIG. 7, adapter 70 has the connection between the slot 1 83 terminal and pin 1 73 broken. The connection between the slot 2 84 terminal and pin 2 74 within adapter 70 is also broken. The slot 1 83 terminal is internally connected to pin 2 74. The slot 3 85 terminal is directly connected electrically to pin 3 75. This wiring arrangement causes a cable assembly 10" connecting two type B components, and into which an adaptor 70 is plugged as shown in FIG. 6, to appear to be a single switch whose pin terminals 2–3 74 and 75 can be connected by another cable assembly 10 to another single switch or other type B device. For this reason it is immaterial into which of the plugs 20' or 30' the adapter pins 1–3 73–75 are inserted.

As a result of these internal connections (or lack thereof), adapter 70 allows any desired number of switches or other devices to be daisy-chained in series connection. One adapter 70 and one cable assembly 10 is required for each additional switch to be daisy-chained in series connection. While the length of the cable 40' connecting the two plugs of assembly 10' can be of a standard short length as shown in FIG. 7, it can also be of any convenient greater length to accommodate type B components located at various places within the installation.

Some safety issues involved should be briefly discussed. If an adapter 70 is mistakenly included in a parallel connection of type A devices, the result is that some or all devices connected to receive power through such a misinstalled adapter 70 will not function because of the break in connectivity between terminal pairs 73 and 83, and 74 and 84 in adapter 70. No power intended to flow through pin 73 to terminal 83 can in fact do so, because pin 73 is not electrically connected to terminal 83 or any other conductor, nor is terminal 84 connected to any other conductor other than a pin 34 that might be plugged into it. This results in a safe failure when adapter 70 is misused, in that a fuel valve 50 or 51 cannot receive power when an adapter 70 is improperly included in the connection. Testing during installation should always reveal such a significant wiring error.

Similarly, if an adapter 70 were to be installed directly on the terminals of a switch 1 60 or switch 2 61 (FIG. 5) when connecting type B components in series, a safe condition also occurs. In this case, the open circuit between slot terminal 84 and every other terminal in adaptor 70 causes the connection to slot terminals 3 85 and 2 84 to appear as an open circuit. This is a safe failure with no power applied to the type B components attached to plugs 20 and 30, and should also be corrected by a competent installer during the normal checkout that occurs at installation.

However, if in the daisy-chained series connection situation (FIG. 6), one cable assembly 10 is directly connected to another without adapter 70 interposed, the switch or other type B components connected to plugs 20" and 30" will be placed in parallel with each other. This parallel switch group will then be in series with the type B component plugged into plug 30'. Because of this possibility, we feel that it is wise to apply on every cable assembly 10, a suitable warning label advising against omitting adapter 70 when daisy-chaining assemblies 10 in the series situation. In addition, a competent installer will check out every safety feature for proper function before completing the installation.

From one standpoint, the availability of an adaptor 70 provides added safety by implying that daisy-chaining two or more cable assemblies 10 for connecting type B components should only be done using adaptor 70. That is, availability of an adaptor 70 for use in with type B components suggests that the procedure for daisy-chaining type B components differs from that of daisy-chaining type A components. Nevertheless, since type B components are often safety-related devices, it is well to provide adequate notice of the importance of including an adaptor 70 between each cable assembly 10 to be daisy-chained.

Accordingly, it is possible to safely use two or more of the universal cable assembly 10 along with an adapter 70 between each to daisy chain as many type B components as is desirable in series connection.

We claim:

1. A cable assembly for electrically connecting components in both serial and parallel, comprising:

a) a cable with first and second ends, and having at least first and second conductors;

b) a first connector plug mechanically attached to the first end of the cable and having at least first, second, and third terminals, said first plug's first and third terminals electrically connected with each other and the first conductor, and said first plug's second terminal electrically connected with the second conductor; and c) a second connector plug mechanically attached to a second end of the cable and having at least first, second, and third terminals, said first terminal electrically connected to the first conductor, and said second terminal electrically connected to the second conductor.

2. The cable assembly of claim 1, wherein the first plug includes a surface having therein first through third slots, into each of which may be inserted the respective one of first through third connecting pins, and where each of the first through third terminals is mounted in the respective slot to make electrical contact with an inserted connecting pin.

3. The cable assembly of claim 2, wherein the second plug includes a) a first surface having therein first through third slots, into each of which may be inserted the respective one of first through third conductive pins and where each of the first through third terminals is mounted in the respective slot to make electrical contact with an inserted connecting pin; and b) a second surface having first through third conductive pins projecting therefrom, said first through third pins electrically connected to the respective first through third slots.

4. The cable assembly of claim 3, wherein the slots each of the first plug and of the second plug have a predetermined polarized geometry, and wherein the second surface of the second plug faces generally away from the first surface of the second plug, and wherein said pins have the predetermined polarized geometry, thereby allowing said pins to enter slots having the predetermined polarized geometry in a one orientation only.

5. First and second of the cable assemblies of claim 4 in combination with a system having first and second type A components to be connected in parallel by said first cable assembly, each type A component having first and second conducting connection pins with the predetermined polarized geometry mounted to enter the first and second slots of either of the first cable assembly's plugs, whereby connecting the first cable assembly to the type A components connects the type A components in parallel with each other and across the first and second pins; and first and second type B components to be connected in series, each type B component having second and third conducting connection pins with the predetermined polarized geometry, with the second and third pins of each of the type B components mounted to enter the second and third slots of either of the second cable assembly's plugs, whereby connecting the second cable assembly to the type B components connects the type B components in series with each other and between the first and third pins.

6. The cable assembly of claim 2, wherein the slots of the first plug are within a surface thereof, said slots in the surface having a predetermined polarized geometry, wherein the slots of the second plug are within a first surface of the second plug, said slots having the predetermined polarized geometry.

7. First and second of the cable assemblies of claim 6 in combination with a system having first and second type A components to be connected in parallel by said first cable assembly, each type A component having first and second conducting connection pins with the predetermined polarized geometry mounted to enter the first and second slots of either of the first cable assembly's plugs, whereby connecting the first cable assembly to the type A components connects the type A components in parallel with each other; and first and second type B components to be connected in series, each type B component having second and third conducting connection pins with the, with the second and third pins of each of the type B components mounted to enter the second and third slots of either of the second cable assembly's plugs, whereby connecting the second cable assembly to the type B components connects the type B components in series with each other and between the first and third pins.

8. An adapter suitable for use with two cable assemblies as defined in claim 7 to connect first through third type B components in series, said adapter comprising a plug having a) a first surface having therein first through third slots having the predetermined polarized geometry, into each of which may be inserted the respective one of first through third conductive pins, where a first terminal is mounted in the first slot to make electrical contact with an inserted connecting pin, and where a third terminal is mounted in the third slot to make electrical contact with an inserted connecting pin; and b) a second surface having second and third conductive pins projecting therefrom and having the predetermined polarized geometry of the second and third slots, said second pin electrically connected to the first terminal and said third pin electrically connected to the third terminal.

9. The adapter of claim 8, wherein the first and second surfaces thereof generally face in opposite directions.

10. An adapter suitable for connecting a first cable assembly as defined in claim 4 with a second similar cable assembly, said adapter comprising a plug having a) a first surface having therein first through third slots having the predetermined polarized geometry, into each of which may be inserted the respective one of first through third conductive pins, where a first terminal is mounted in the first slot to make electrical contact with an inserted connecting pin, and where a third terminal is mounted in the third slot to make electrical contact with an inserted connecting pin; and b) a second surface having second and third conductive pins projecting therefrom and having the predetermined polarized geometry of the second and third slots, said second pin electrically connected to the first terminal and said third pin electrically connected to the third terminal.

11. The adapter of claim 10, wherein the first and second surfaces thereof generally face in opposite directions.

* * * * *